US005713680A

United States Patent [19]

Yoshino et al.

[11] Patent Number: 5,713,680

[45] Date of Patent: Feb. 3, 1998

[54] COMBINED WRITING TOOL

[75] Inventors: Tokiyoshi Yoshino, Tokyo; Yoshihide Mitsuya; Shouji Anzai, both of Kawagoe, all of Japan

[73] Assignee: Crown Fancy Goods Co., Ltd., Tokyo, Japan

[21] Appl. No.: 508,528

[22] Filed: Jul. 28, 1995

[30] Foreign Application Priority Data

Nov. 10, 1994 [JP] Japan ..... 6-301389

[51] Int. Cl.[6] ..... B43K 27/02

[52] U.S. Cl. ..... 401/30; 401/32; 401/33

[58] Field of Search ..... 401/29, 30, 32, 401/33

[56] References Cited

U.S. PATENT DOCUMENTS 3,923,404 12/1975 Heinz ..... 401/33
3,989,389 11/1976 Hashimoto et al. ..... 401/30

FOREIGN PATENT DOCUMENTS 696128 10/1965 Italy ..... 401/33
234299 9/1989 Japan ..... 401/29

*Primary Examiner*—Steven A. Bratlie
*Attorney, Agent, or Firm*—Oblon, Spivak, McClelland, Maier & Neustadt, P.C.

[57] ABSTRACT

A combined writing tool comprises a cylindrical casing; a push button extended from the top end of said cylindrical casing by force of a spring; a plurality of writing cartridges arranged in the casing and adapted to be alternatively extended from the bottom end of the casing through a small aperture formed therein; and a cam arranged in the casing and adapted to cause a tip of either one of the writing cartridges to be alternatively extended from and retracted in the casing through the small aperture in response to the pushing operation of the push button. The combined writing tool makes it possible to extend or retract either one of the writing cartridges from or into the casing through the small aperture only by a pushing operation of the push button. Thus easy operation can be obtained and unwanted extension of the writing cartridge can be prevented. In addition, it is possible to prevent an erroneous operation during an exchange of the writing cartridge, to enable an easy one-hand operation, to improve the reliability of the mechanism, and to reduce a size of the mechanism.

14 Claims, 14 Drawing Sheets

COMBINED WRITING TOOL

BACKGROUND OF THE INVENTION

1. Field of the Invention

The present invention relates to a combined writing tool including writing cartridges such as a ballpoint pen, a mechanical pencil and the like.

2. Discussion of the Background

Conventional combined writing tools include, for example, a type in which the point of either one writing cartridge can be selectively extended from the casing (barrel) for use by a knocking operation while keeping the writing cartridge directed downward (see Japanese Utility Model Publication No. 3352/1993); and a type in which different kinds of pen shafts are slidably arranged within a casing in which a knocking shaft is also slidably arranged usually urged rearward, a select ring is arranged at a predetermined position on the knocking shaft such that it limits the axial movement of the pen shaft and selectively engages the rear end of the pen shaft positioned at a lower side within the casing due to the descendent motion by its own weight, and only the pen shaft positioned at the lower side within the casing can be selected and thrusted out from the casing by a simple knocking operation of the knocking shaft (see Japanese Laid-open Patent Publication No. 117797/1987).

However, either conventional combined writing tool mentioned above requires a user to firstly grip the writing tool horizontally so that the desired writing cartridge or pen shaft is positioned at the lower side within the casing and then to re-grip the writing tool for use, which is very cumbersome.

SUMMARY OF THE INVENTION

It is, therefore, an object of the present invention to provide for a combined writing tool in which one of a plurality of writing cartridges can be alternatively extended from and retracted in the casing through a small aperture formed therein by a simple knocking operation by one hand while holding the writing tool in any position without being limited to a horizontal position.

It is a further object of the present invention to provide for a combined writing tool having a simple structure for operating the writing cartridge and thus providing high reliability of the mechanism as well as a small size.

For achieving these objects, there is provided, according to the present invention, a combined writing tool comprising a cylindrical casing; a push button extended from the top end of the cylindrical casing by force of a spring; a plurality of writing cartridges arranged in the casing and adapted to be alternatively extended from the bottom end of the casing through a small aperture formed therein; and a cam arranged in the casing and adapted to cause a tip of either one of the writing cartridges to be alternatively extended from and retracted in the casing through the small aperture in response to the pushing operation of the push button.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
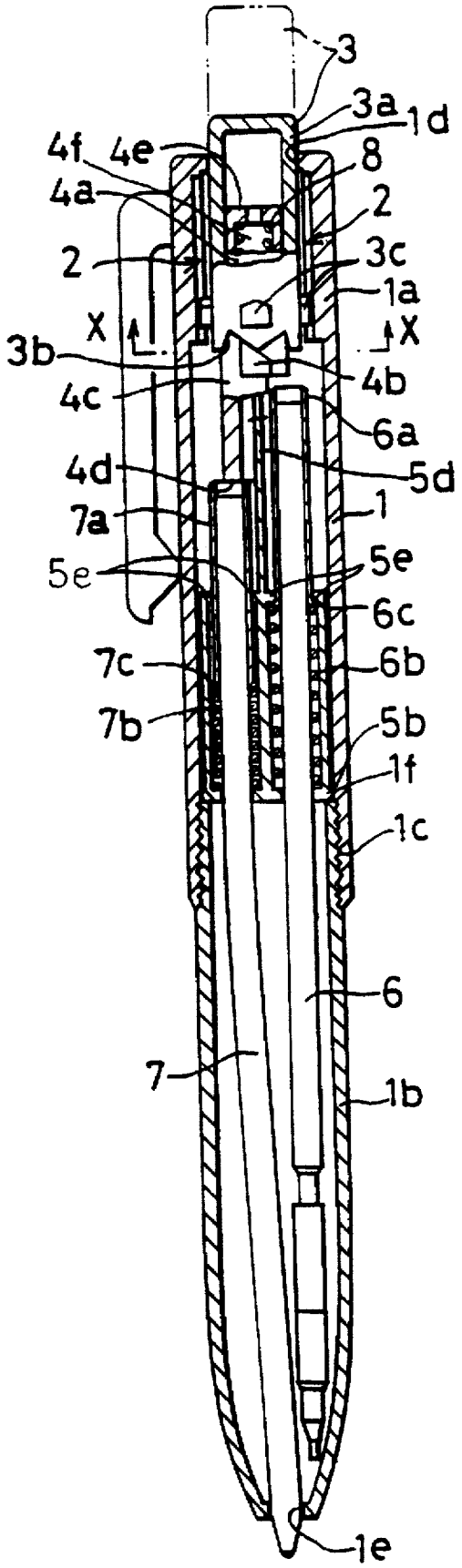
FIG. 1 is a longitudinal section view showing a first embodiment of the present invention.

Referring now to the drawings, wherein like reference numerals designate identical or corresponding parts throughout the several views, a first embodiment of the present invention will be hereinafter described with reference to FIGS. 1 through 19.

A reference numeral 1 denotes a barrel or cylindrical casing comprising an upper casing la and a lower casing 1*b*which are releasably coupled together through a thread 1*c*. At the top of the upper casing 1*a*, there is formed a through-aperture 1*d*. As can be seen in FIGS. 3 through 6, there is formed, on the inner surface of the upper casing 1*a* at the upper portion thereof, a first ridge 2*a* and a second ridge 2*c* which are spaced apart from each other by a shallow first groove 2*b*. Bottom ends of the first ridge 2*a* and the adjacent first groove 2*b* are formed as a continuous first inclined surface 2*d*. A bottom end of the second ridge 2*c* is formed as a second inclined surface 2*e*. At a middle of the second ridge 2*c* there is formed a shoulder having a bottom end which is formed as a third inclined surface 2*f*. The shoulder is adjacent to a deep second groove 2*g* which is at the same level as the inner surface of the casing 1.

Figure 5:
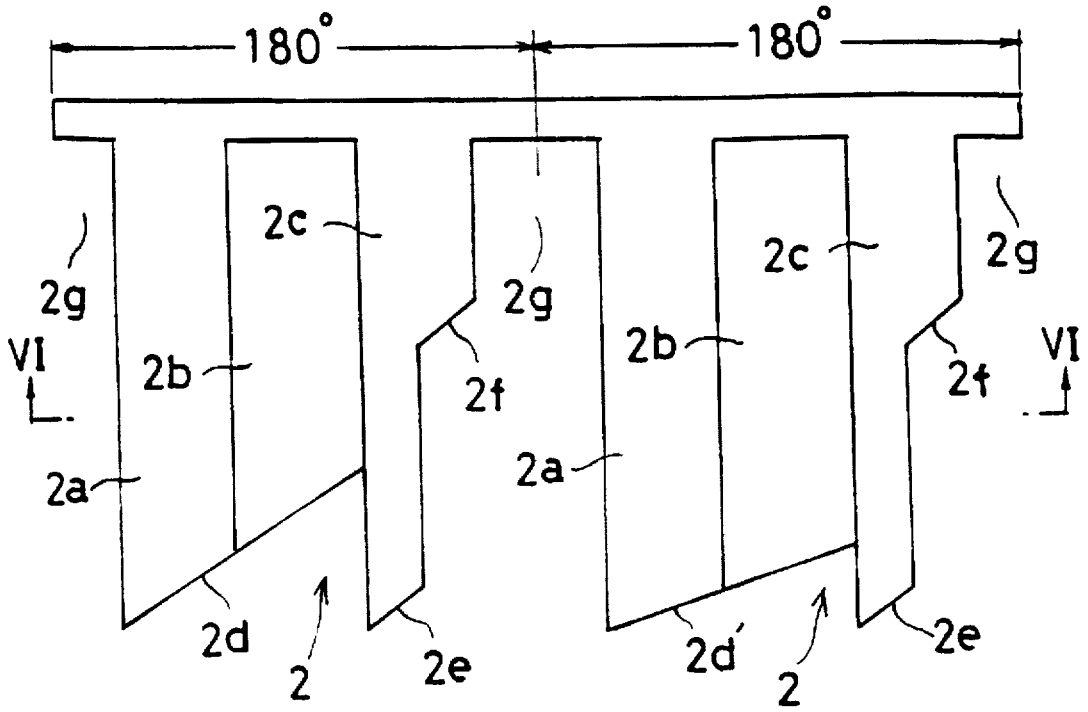
FIG. 5 is a development of a main portion of FIG. 3.
Figure 6:
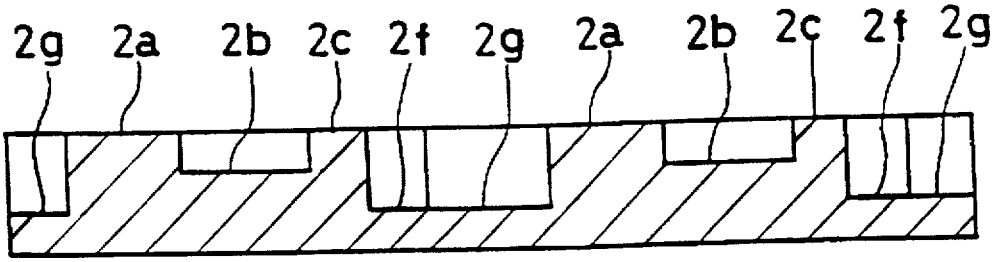
FIG. 6 is a cross-sectional view taken along a line VI—VI of FIG. 5.

As shown in FIG. 5, these ridges 2*a* and 2*c*, the shoulder and its bottom end 2*f*, and the grooves 2*b* and 2*g* are arranged at a circumferential region of 180° on the inner surface of the casing 1 and form a first set of substantially saw-toothed tips 2. Similarly, a second set of substantially saw-toothed tips 2 is formed on the inner surface of the casing 1 at the remaining 180° circumferential region thereof. As clearly shown in FIG. 5, a difference in height of the first inclined surface 2*d* and the second inclined surface 2*e* of the first set of tips 2 is larger than a difference in height of the first inclined surface 2*d'* and the second inclined surface 2*e* of the second set of tips 2. Thus the first inclined surface 2*d* is also hereinafter referred to as "steeply inclined surface" and the other first inclined surface 2*d'* is referred to as "gently inclined surface". As hereinafter described, a writing cartridge 6 of a mechanical pencil requires a long pushing stroke of a push button 3 for thrusting a lead, and on the contrary a writing cartridge 7 of a ballpoint pen does not require the lead thrusting operation and thus can be operated with a short pushing stroke. Accordingly the first set of tips 2 having a larger height difference therebetween is to be used for a writing cartridge 6 of a mechanical pencil and the second set of tips 2 having a smaller height difference therebetween is to be used for a writing cartridge 7 of a ballpoint pen.

A small aperture is 1*e* formed at the bottom end of the lower casing 1*b* and a step If is formed at a conjunction between the upper casing 1*a* and the lower casing 1*b*.

Figure 7:
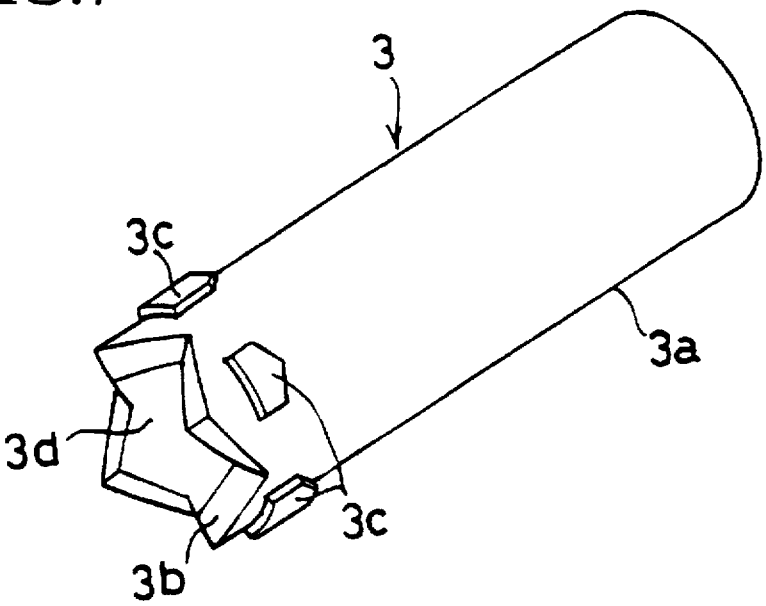
FIG. 7 is a perspective view of a push button used in the combined writing tool of the present invention.
Figure 8:
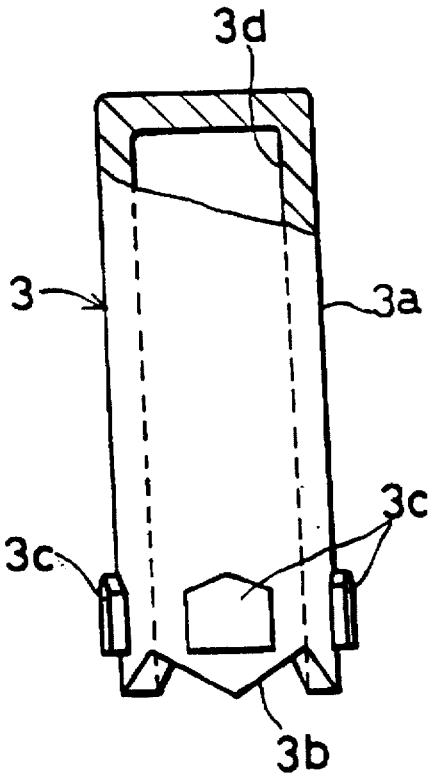
FIG. 8 is a partially sectioned front elevational view of the push button of FIG. 7.
Figure 9:
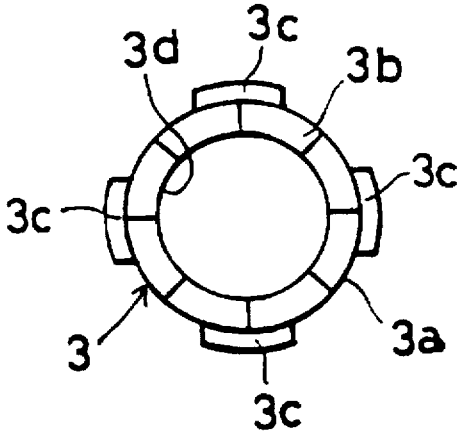
FIG. 9 is a bottom view of the push button of FIG. 7.
Figure 10:
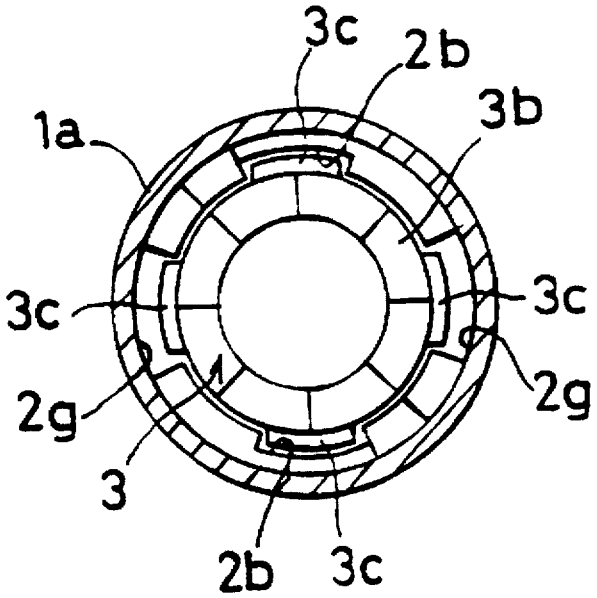
FIG. 10 is a cross-sectional view taken along a line X—X of FIG. 1.

As shown in FIGS. 7 through 9, a push button 3 is formed as a cylindrical body 3*a* having a closed top surface suitable to be pushed by a finger. Four V-shaped recesses 3*b* are formed on the bottom end of the cylindrical body 3*a* and projections 3*c* are formed on the outer circumferential surface of the cylindrical body 3*a*. The cylindrical body 3*a* is inserted into the through-aperture 1*d* of the upper casing 1*a* and extended therefrom. As shown in FIG. 10, each projection 3*c* is received in the first and second grooves 2*b* and 2*g* and slidably engages therewith so as to be able to be reciprocally extended from and retracted in the upper casing 1*a* through through-aperture 1*d* without rotation.

Figure 11:
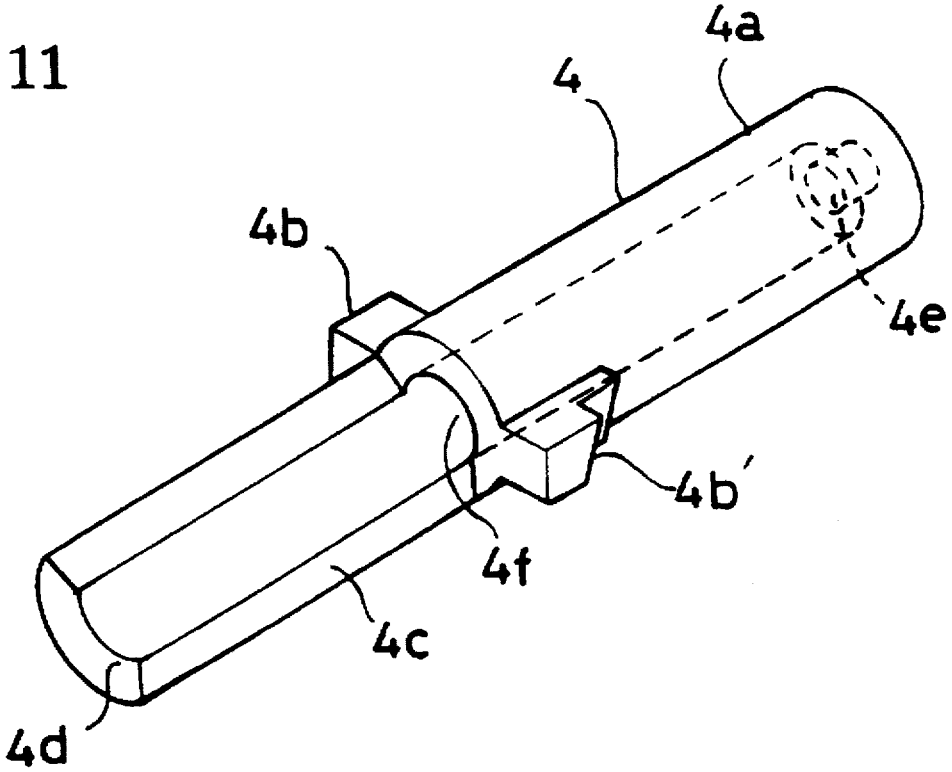
FIG. 11 is a perspective view of a cam used in the combined writing tool of the present invention.
Figure 12:
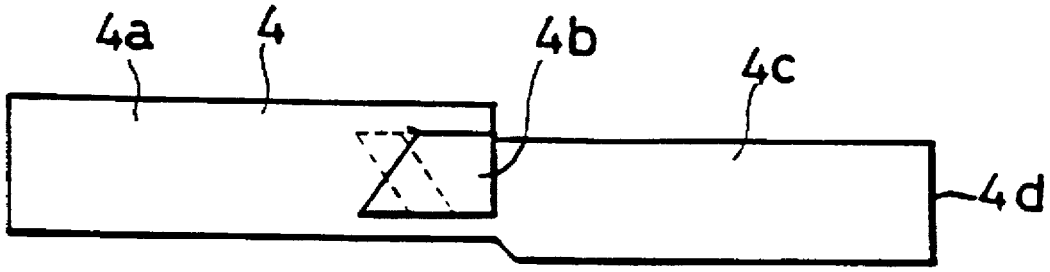
FIG. 12 is a front elevational view of the cam.
Figure 13:
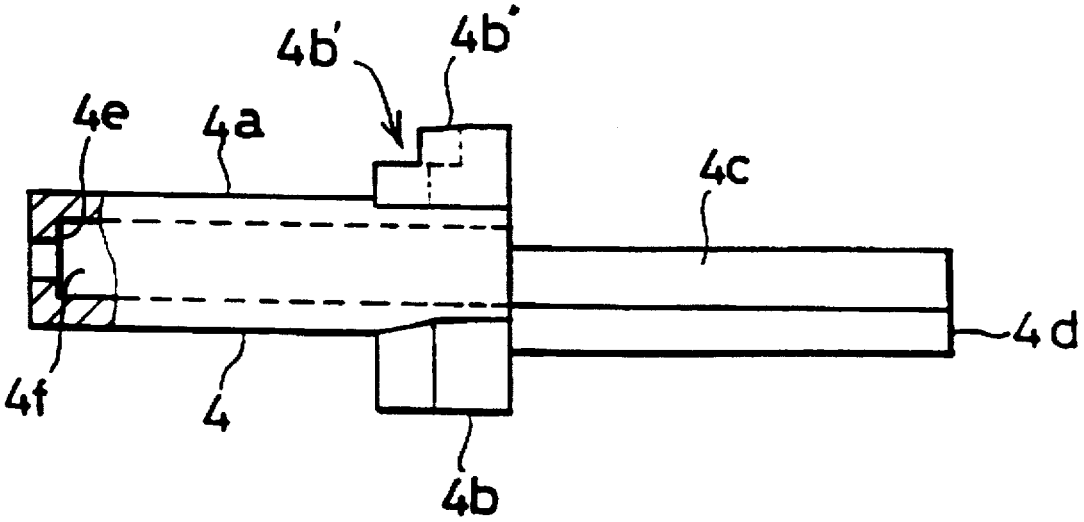
FIG. 13 is a partially sectioned plan view of the cam of FIG. 1.

As shown in FIGS. 11 through 13, a reference numeral 4 denotes a cam 4 and the upper half thereof is formed as a cylindrical body 4*a* which is adapted to be rotatably and slidably fitted into a central bore 3*d* of the push button 3. A trapezoidal projection 4*b* is formed on the outer circumferential surface of the cylindrical body 4*a* at a lower end thereof and another trapezoidal projection 4*b'* having a step is also formed on the outer circumferential surface of the cylindrical body 4*a* at a position diametrically opposite to the trapezoidal projection 4*b*.

The cam 4 also has a pushing rod 4*c* projected from the bottom end of said cylindrical body 4*a* and having a semilunar pushing surface 4*d* at the bottom of the pushing rod 4*c*. A bore 4*f* having an upper wall 4*e* is also formed in the cylindrical body 4*a*.

Figure 2:
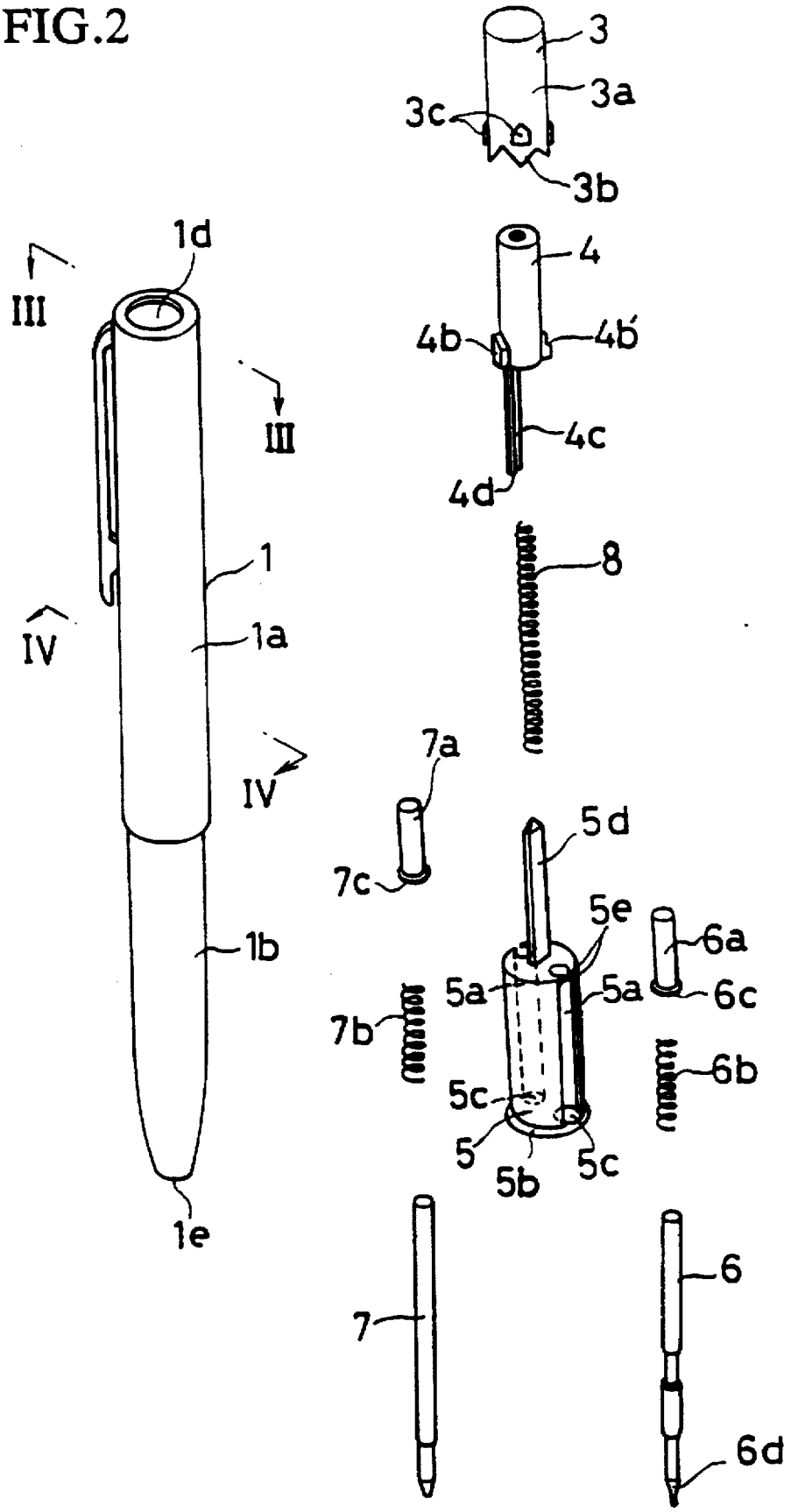
FIG. 2 is an exploded perspective view of the combined writing tool of FIG. 1.
Figure 3:
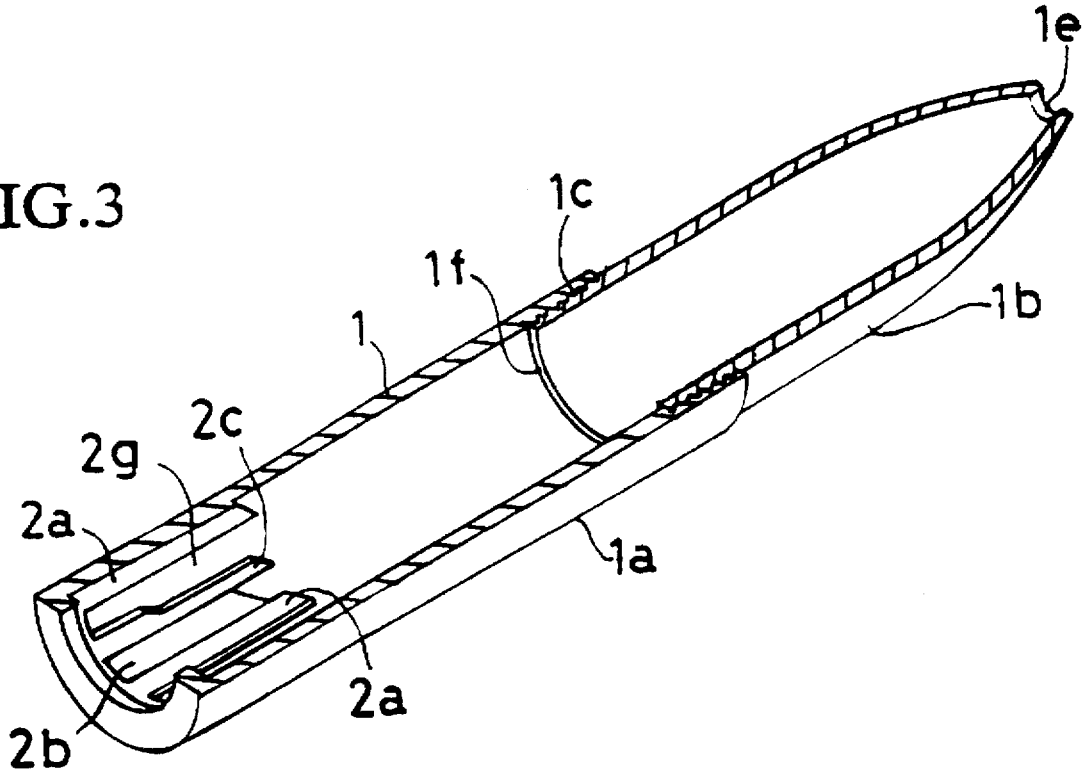
FIG. 3 is a cross-sectional view taken along a line III—III of FIG. 2.
Figure 4:
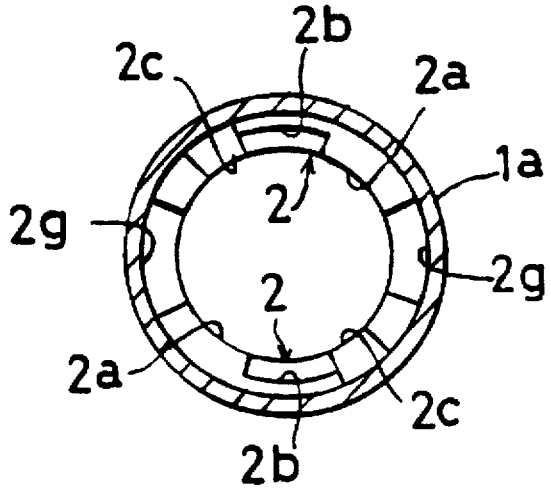
FIG. 4 is a cross-sectional view taken along a line IV—IV of FIG. 2.

As shown in FIG. 2, a cartridge holder 5 is formed, on its outer circumferential surface, with holding grooves 5*a* for holding writing cartridges 6 and 7 and with a shoulder 5*b* in which small apertures 5*c* for passages of the writing cartridges 6 and 7 are formed. The bottom surface of the shoulder 5*b* is urged against the step if of the casing 1 by a spring 8 which will be hereinafter described and is secured in place within the casing 1.

Integrally formed with the holder 5 is a rod 5*d* projecting from the upper surface thereof. The rod 5*d* is adapted to be loosely inserted into the bore 4*f* of the cylindrical cam 4 along the pushing rod 4*c* thereof. The spring 8 is arranged around the rod 5*d* such that the bottom end of the spring 8 contacts the top surface of the holder 5 and the top end of the spring 8 abuts against the upper wall 4*e* of the bore 4*f* and accordingly the push button 3 is extended from the casing 1 by the spring 8 via the cam 4.

The writing cartridge 6 is, for example, a mechanical pencil cartridge and the writing cartridge 7 is, for example, a ballpoint pen. The writing cartridges 6 and 7 are mounted on the holder 5 by using refill receptacles 6*a* and 7*a* respectively fitted on the top ends of the writing cartridges 6 and 7, by arranging coil springs 6*b* and 7*b* between the shoulder 5*b* of the holder 5 and the refill receptacles 6*a* and 7*a* and by engaging flanges 6*c* and 7*c* formed on the bottom end of the refill receptacles 6*a* and 7*a* with stoppers 5*e* projected from the top end of the holding grooves 5*a* in order to prevent the writing cartridges 6 and 7 from being pulled out from the holder 5.

The operation of the writing tool of the aforementioned embodiment will be hereinafter described with reference to FIGS. 14 through 19.

Let it be supposed that both the mechanical pencil cartridge 6 and the ballpoint pen cartridge 7 are now retracted in the casing 1. When pushing the push button 3 downward against the force of the coil spring 8 until it is stopped, the V-shaped recesses 3*b* at the bottom surface of the push button 3 is lowered from a position shown by a solid line in FIG. 14 to a position shown by a phantom line. Accompanying with this descendant motion of the push button 3, the trapezoidal projection 4*b* of the cam 4 is also lowered from a position "A" in FIG. 14 along an arrow "J" with keeping a condition shown in FIGS. 15 and 17.

During this time, the pushing surface 4*d* is positioned above the top end of the mechanical pencil cartridge 6 (FIG. 16A), pushes the cartridge 6 downward along with the downward movement of the cam 4 against the force of the coil spring 6*b* and extends the point of the cartridge 6 through the small aperture is of the lower casing 1*b*.

When the top end of the trapezoidal projection 4*b* of the cam 4 is passed over the bottom end of the saw-toothed tip of the first ridge 2*a* formed on the inner circumferential surface of the upper casing la, the trapezoidal projection 4*b* is freed from the restriction of the first ridge 2*a*, is permitted to slightly rotate along the inclined surface of the V-shaped recess 3*b* of the push button 3 as shown by an arrow "K" and arrives at a position "B" (FIG. 14) which is a bottom of the valley of the V-shaped recess 3*b*.

Releasing the pressure applied to the push button 3 at the position "B", the V-shaped recesses 3*b* of the push button 3 is moved upward by the force of the spring 8 to the position shown by the solid line from the position shown by the phantom line. Accompanying with this ascendant motion of the push button 3, the trapezoidal projection 4*b* of the cam 4 also moves upward along an arrow "L" from a position "B" (FIG. 14), then slightly rotates along the steeply inclined first surface 2*d* as shown by an arrow "M" and stops at a position "C" which is a bottom of the steeply inclined surface 2*d* i.e. within the shallow groove 2*b* as shown FIGS. 14 and 15.

Figure 16A:
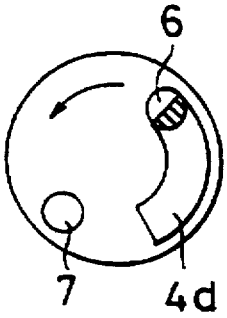
FIGS. 16A, 16B, 16C and 16D are explanatory views showing a mutual actuating relation between the cam and the writing cartridge.
Figure 16B:
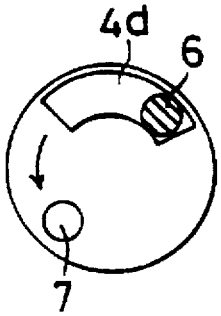
Figure 18:
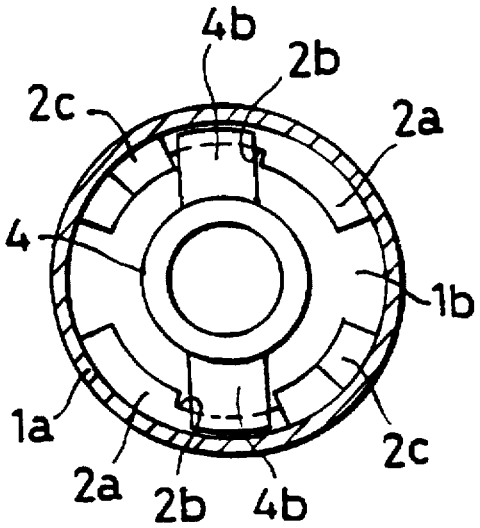
FIG. 18 is a cross-sectional view similar to FIG. 17 showing a relation between the cam and the casing.

The cam 4 at this step is in a position as shown in FIGS. 16B and 18. That is, although the cam 4 has been rotated over 90° from the position "A" to the position "C" (FIG. 14), the semilunar pushing surface 4*d* of the cam 4 is still remained in a condition in which it suppresses the mechanical pencil cartridge 6 to keep the point of the cartridge 6 extended from the small aperture 1*e* of the casing 1.

Figure 19:
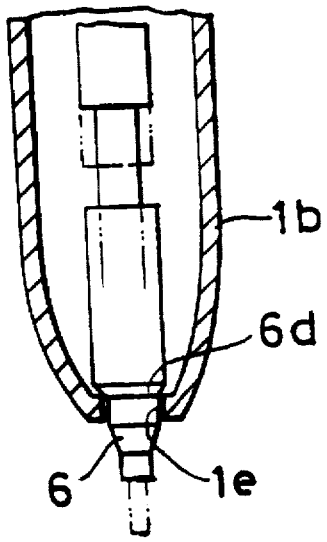
FIG. 19 is a cross-sectional view showing a distal end portion of the casing and the mechanical pencil cartridge.

Under such a condition, if repeating small knocking operation of the push button 3 as shown by an arrow "N" (FIG. 14) so that the top end of the trapezoidal projection 4b of the cam 4 is not moved downward beyond the bottom end of the second ridge 2e formed on the inner circumferential surface of the upper casing 1a, a shaft of the mechanical pencil cartridge 6 is also repeatingly reciprocated in a conventional manner as shown by a phantom line in FIG. 19 with a shoulder 6d of the cartridge 6 being abutted with the inner edge of the small aperture 1e of the lower casing 1b. Thus the lead in the cartridge 6 is thrusted out therefrom.

Then, if deeply pushing down the push button 3 until it is stopped as shown by an arrow "O" the top end of the trapezoidal projection 4b is moved downward beyond the bottom end of the second ridge 2c. Thus, the trapezoidal projection 4b is freed from the restriction of the ridge 2a, ridge 2a, is permitted to slightly rotate along the inclined surface of the V-shaped recess 3b of the push button 3 as shown by an arrow "P" and arrives at a position "D" (FIG. 14) which is a bottom of the valley of the V-shaped recess 3b. Then if releasing the pressure applied on the push button 3, the trapezoidal projection 4b of the cam 4 is moved upward by the force of the spring 8, and is slightly rotated along an arrow "Q". During this time, the mechanical pencil cartridge 6 is also moved upward by the force of the spring 6b, being kept in contact with the semilunar pushing surface 4d and thus the point of the cartridge 6 is retracted in the casing 1.

Thereafter, the trapezoidal projection 4b is moved upward by the force of the spring 8 apart from the second inclined surface 2e as shown by an arrow "R" and is slightly rotated along the third inclined surface 2f.

Figure 14:
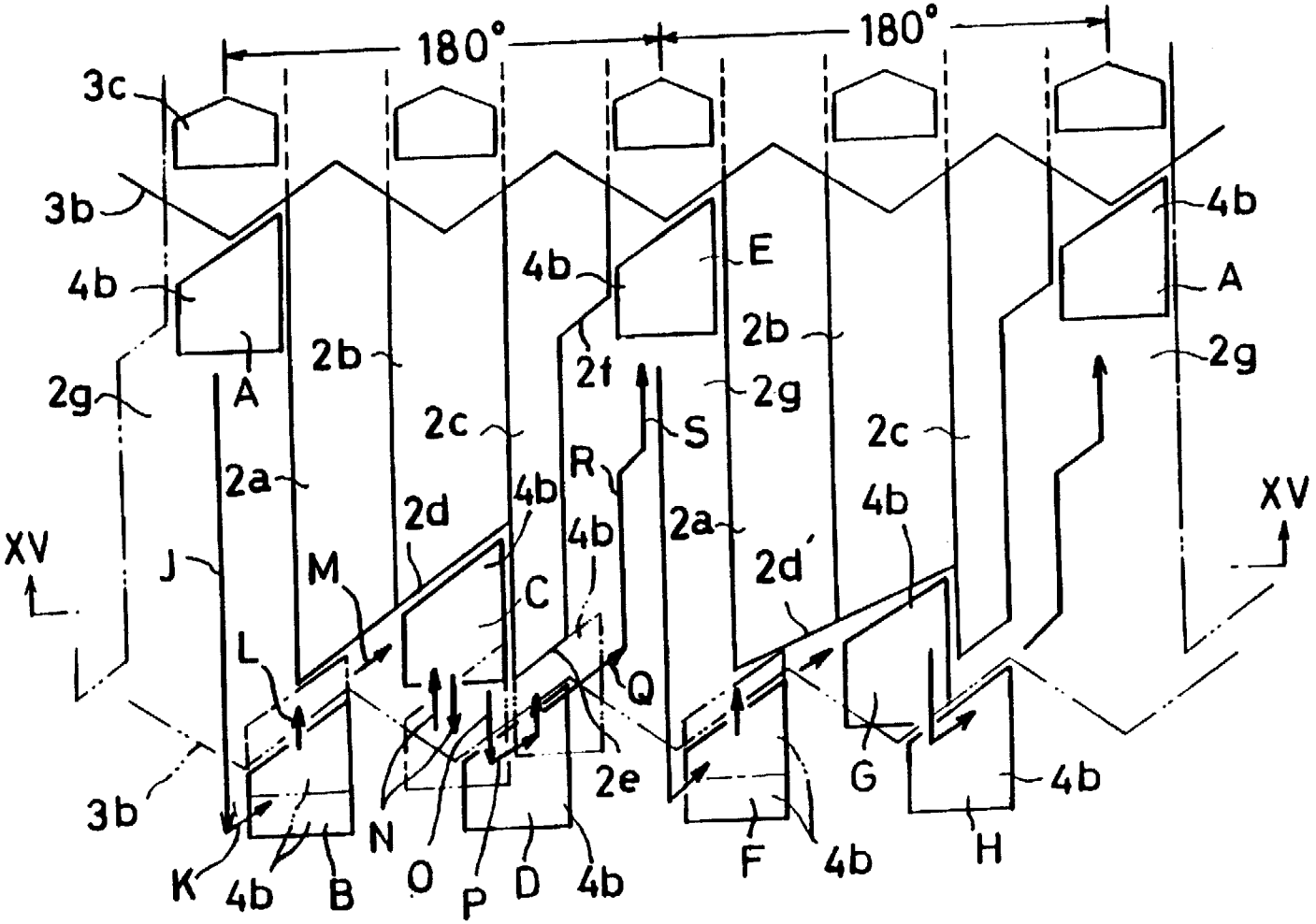
FIG. 14 is an explanatory view showing the sequential motion of the cam caused by the push button.
Figure 15:
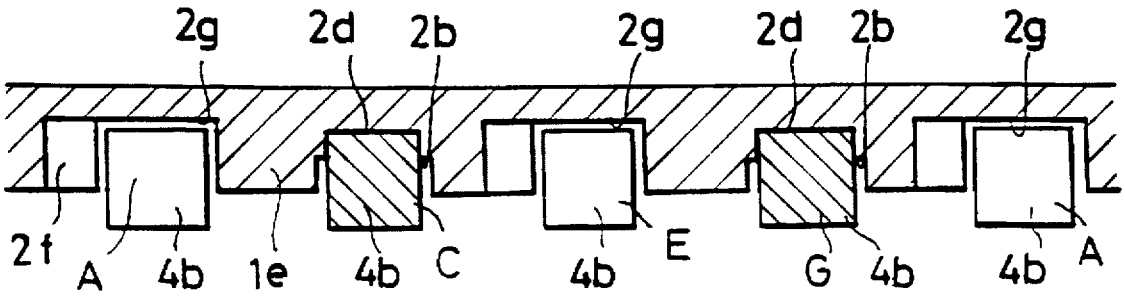
FIG. 15 is an explanatory cross-sectional view taken along a line XV—XV of FIG. 14.

Then, the trapezoidal projection 4b is moved upward by the force of the spring 8 apart from the third inclined surface 2f as shown by an arrow "S" and occupies a position "E" shown in FIGS. 14 and 15.

Figure 16C:
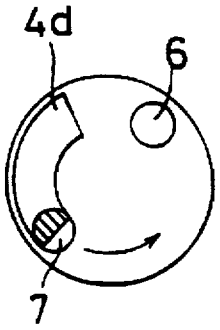
Figure 16D:
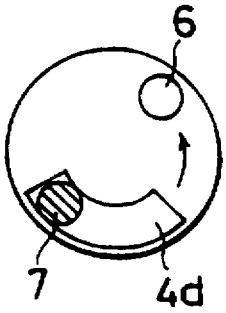
Figure 17:
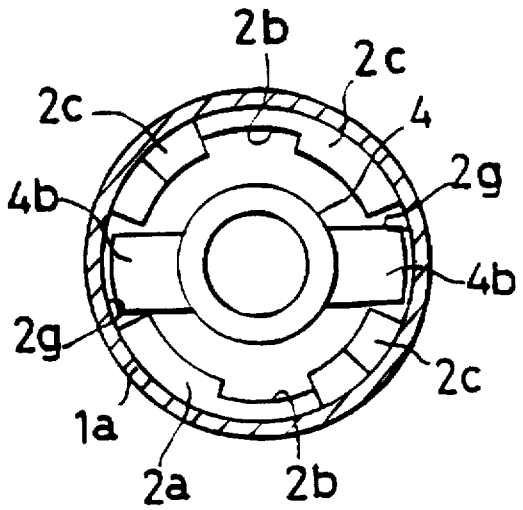
FIG. 17 is a cross-sectional view showing a relation between the cam and the casing.

Accordingly, the semilunar surface 4d of the cam 4 is further rotated over 90° toward a position of FIG. 16C in which although the ballpoint pen cartridge 7 is retracted in the casing 1, it is possible to push the ballpoint pen cartridge 7 downward to extend it from the small aperture 1e of the casing 1 by pushing the push button 3 downward.

If pushing down the push button 3 against the force of the coil spring 8 and then releasing the pressure applied to the push button 3, the cam 4 is rotated over 90° from the position "E" shown in FIGS. 14 and 15 to a position "G" via a position "F" on the gentle inclined surface 2d' and aperture 1e.

During this time, it is possible to shorten the thrusting stroke of the ballpoint pen cartridge, since the projection 4b' is formed with a step and a lower inclined surface of an outward trapezoidal projection 4b' having a low height is not contacted with the first steeply inclined surface 2d and the projection 4b is contacted only with the first gently inclined surface 2d'.

That is, although a long thrusting stroke is required for the mechanical pencil 6 in order to thrust the lead, the ballpoint pen cartridge 7 not having any necessity of the lead thrusting operation does not require such a long stroke. This is a reason to shorten the thrusting stroke of the ballpoint pen cartridge.

Then, if pushing down the push button 3 until it is stopped and releasing the pressure applied to the push button 3, the projection 4b is rotated over 90° from the position "G" shown in FIGS. 14 and 15 to the initial position "A" via a position "H" and thus the ballpoint pen cartridge 7 is retracted in the casing 1.

Although it is described that the ridges and grooves are integrally formed on the inner circumferential of the upper casing 1a, it may be possible to form these ridges and grooves on a separate member and to unite the member to the upper casing 1a, for example, by adhesive.

A second embodiment of the present invention will be hereinafter described with reference to FIG. 20.

Figure 20:
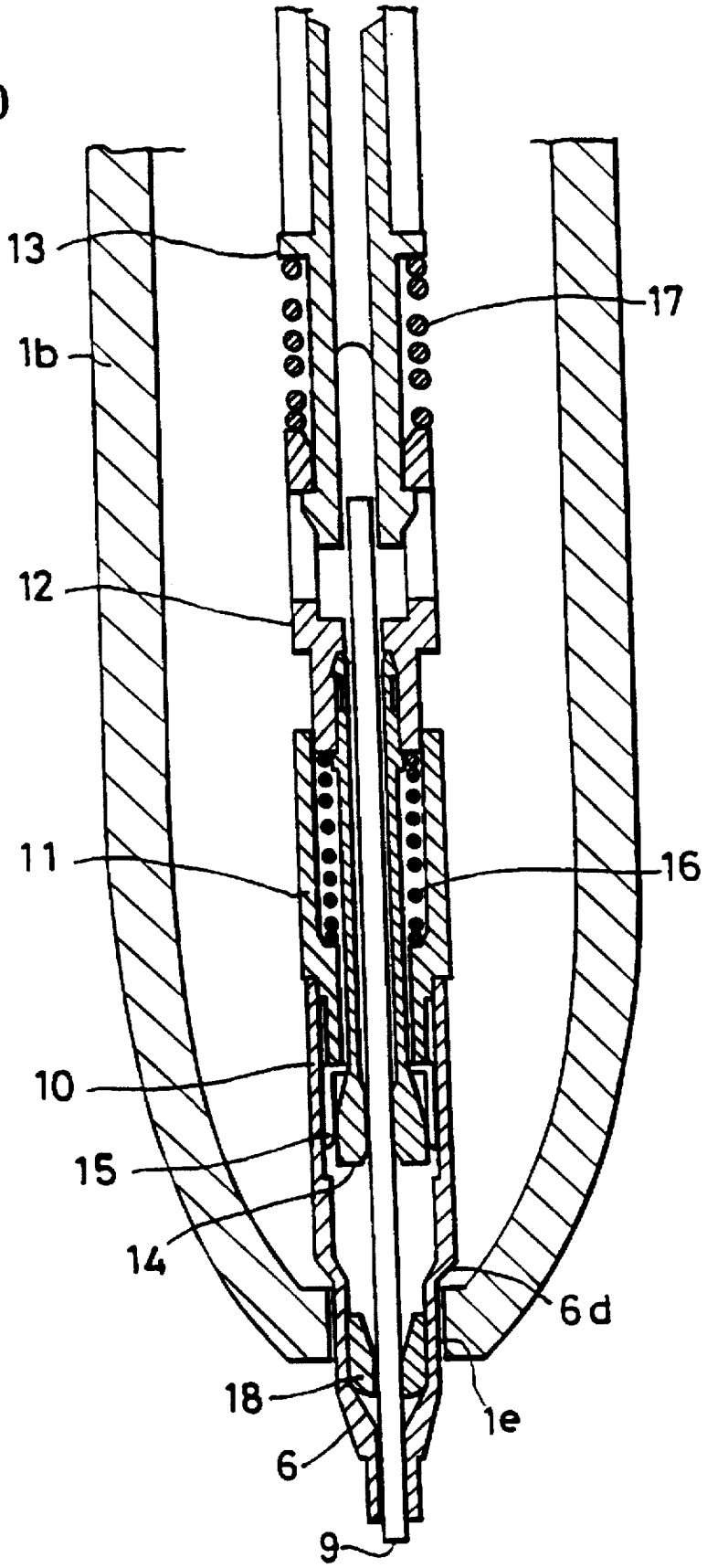
FIG. 20 is a cross-sectional view showing a second embodiment of the mechanical pencil cartridge.

In FIG. 20, a reference numeral 9 denotes a lead of the mechanical pencil cartridge 6; similarly, a numeral 10 a first shaft; a numeral 11 a second shaft; a numeral 12 a third shaft; a numeral 13 a fourth shaft; a numeral 14 a chuck; a numeral 15 a presser ring; a numeral 16 a first return spring having a low spring constant (i.e. a first weak return spring); a numeral 17 a second return spring having a high spring constant (i.e. a second strong return spring); and a numeral 18 a lead guide. Although only one shaft (i.e. a third shaft 12) is used as a lead thrusting shaft and one return spring 16 is used as a return spring in the conventional mechanical pencil cartridge shown in FIG. 19, the cartridge of the second embodiment has a lead thrusting shaft comprising two stage shafts i.e. the third shaft 12 and the fourth shaft 13 and additionally the first weak return spring 16 and the second strong return spring 17.

During the lead thrusting operation, when softly pushing the push button 3, only the first weak return spring 16 is compressed without compressing the second strong spring 17; and the third shaft 12 pushes the chuck 14 and thrusts the lead 9 with holding the lead 9 until the chuck 14 is disengaged from the presser ring 15. If the thrusted amount of the lead is not sufficient, such soft pushing operation of the push button 3 should be repeated until a desired length of the lead is thrusted.

When a user wishes to contain the mechanical pencil cartridge 6 within the casing 1 or to change over from the mechanical pencil cartridge 6 to the ballpoint pen cartridge 7, the push button 3 should be strongly or deeply pushed. The strong pushing operation of the push button 3 compresses not only the first weak return spring 16 but the second strong return spring 17 and moves the projection 4b from the position "C" to the position "D" (FIG. 14) and then the projection is moved to the position "E" when the pressure applied to the push button 3 is released.

That is, the provision of the weak and strong return springs makes it possible to select either the lead thrusting operation or the cartridge changing over operation by pushing the push button 3 softly or deeply.

A third embodiment of the present invention will be hereinafter described with reference to FIG. 21.

Figure 21:
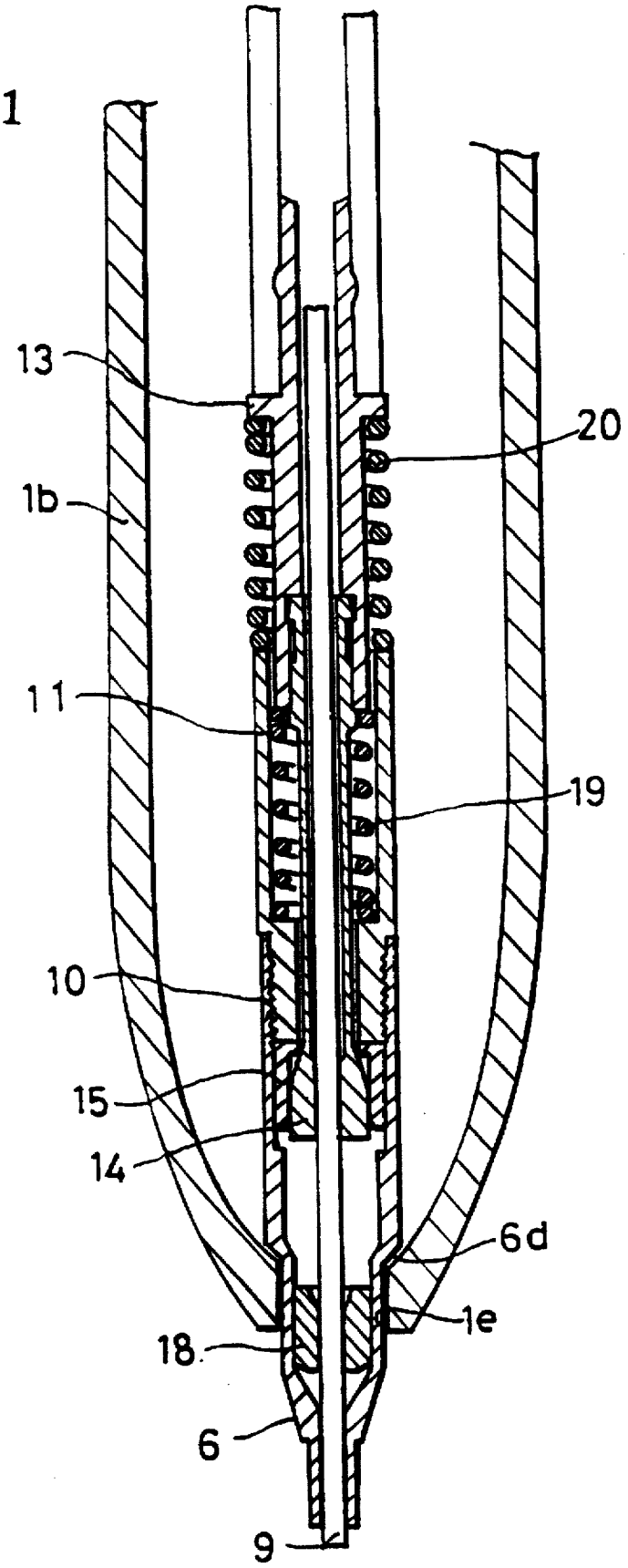
FIG. 21 is a cross-sectional view showing a third embodiment of the mechanical pencil cartridge.

In FIG. 21, a reference numeral 9 denotes a lead of the mechanical pencil cartridge 6; similarly, a numeral 10 a first shaft; a numeral 11 a second shaft; a numeral 12 a third shaft; a numeral 13 a fourth shaft; a numeral 14 a chuck; a numeral 15 a presser ring; a numeral 18 a lead guide; a numeral 19 a first return spring having a low spring constant; and a numeral 20 a second return spring having a high spring constant.

The third embodiment is different from the second embodiment in that the third shaft 12 of the second embodiment is omitted and thus the structure of the third embodiment is simplified and in that the first weak return spring 19 is fitted under an initially precompressed condition and the second strong return spring 20 is fitted under a noncompressed condition and thus the cartridge 6 can be returned by the weak return spring 19.

During the lead thrusting operation, when softly pushing the push button 3, only the first weak return spring 16 is compressed without compressing the second strong spring 17; and the fourth shaft 13 pushes the chuck 14 and thrusts the lead 9 with the chuck 14 holding the lead 9 until the chuck 14 is disengaged from the presser ring 15. Since the lead thrusting stroke is short, the amount of compression of the second strong return spring 20 is a little and thus the reaction force caused by the spring 20 is small.

If the thrusted amount of the lead is not sufficient, several times of the thrusting operation of the push button 3 should be repeated until a desired length of the lead is thrusted.

When a user wishes to contain the mechanical pencil cartridge 6 within the casing 1 or to change over from the mechanical pencil cartridge 6 to the ballpoint pen cartridge 7, the push button 3 should be strongly or deeply pushed. Of course, the strong pushing operation of the push button 3 causes a compression of the first weak return spring 19 and also causes a compression of the second strong return spring 20 with a long stroke generating a strong reaction force. This moves the projection **4*b* from the position "C" to the position "D" (FIG. 14) and then the projection is moved to the position "E" when the pressure applied to the push button 3** is released.

That is, the modification of the initially mounted condition of the weak and strong return springs makes it possible to select either the lead thrusting operation or the cartridge changing operation by pushing the push button 3 softly or deeply.

A fourth embodiment of the present invention will be hereinafter described with reference to FIG. 22.

Figure 22:
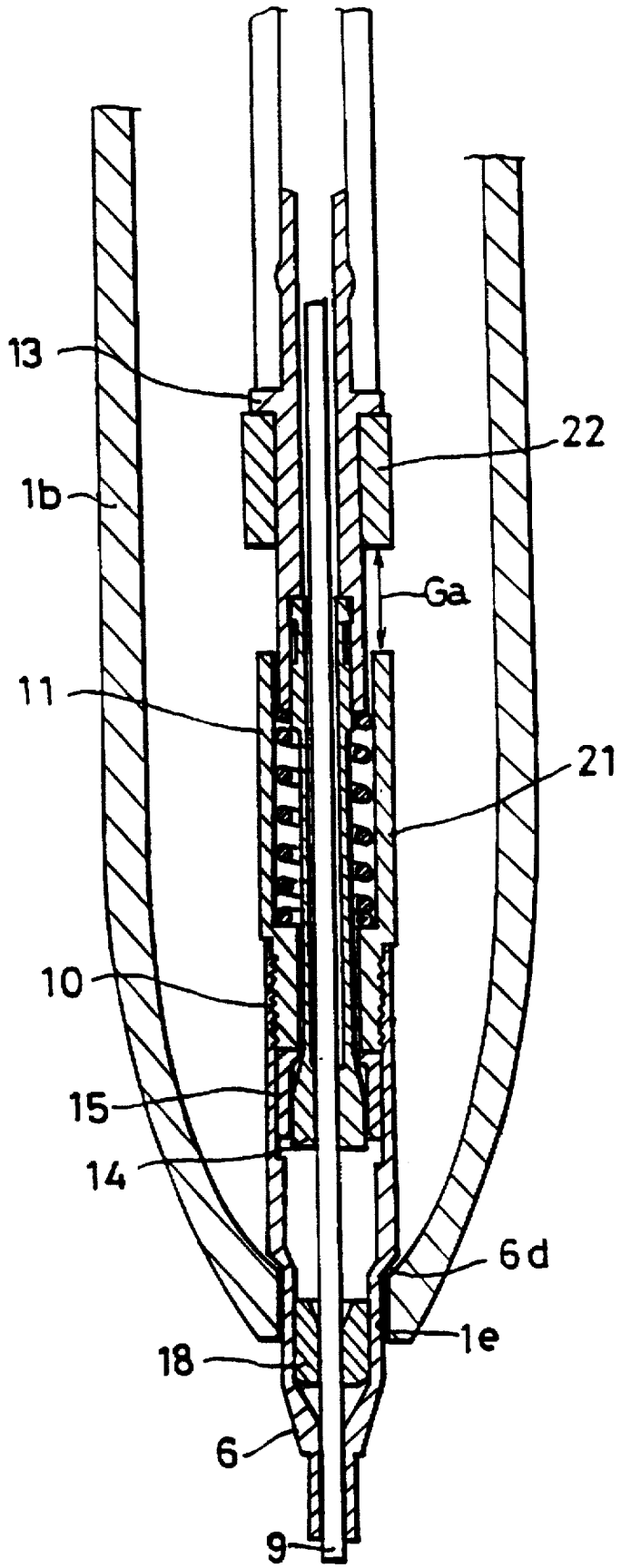
FIG. 22 is a cross-sectional view showing a fourth embodiment of the mechanical pencil cartridge.

In FIG. 22, a reference numeral 9 denotes a lead of the mechanical pencil cartridge 6; similarly, a numeral 10 a first shaft; a numeral 11 a second shaft; a numeral 13 a fourth shaft; a numeral 14 a chuck; a numeral 15 a presser ring; a numeral 18 a lead guide; a numeral 21 a third return coil spring; a numeral 22 an elastic ring of rubber or soft plastic; and a symbol "Ga" a distance required for lead thrusting.

The fourth embodiment is different from the third embodiment in that the second return spring 20 in the third embodiment is replaced with the elastic ring 22 and the distance "Ga" required for lead thrusting.

During the lead thrusting operation, when softly pushing the push button 3, the third return spring 21 is compressed by the amount of the distance "Ga"; the fourth shaft 13 pushes the chuck 14 and thrusts the lead 9 with holding the lead 9 until the chuck 14 is disengaged from the presser ring 15; during which the elastic ring 22 is not compressed at all.

If the thrusted amount of the lead is not sufficient, several times of the thrusting operation of the push button 3 should be repeated until a desired length of the lead is thrusted.

When a user wishes to contain the mechanical pencil cartridge 6 within the casing 1 or to change over from the mechanical pencil cartridge 6 to the ballpoint pen cartridge 7, the push button 3 should be strongly or deeply pushed. Of course, the strong pushing operation of the push button 3 causes a compression of the third return spring 21; the distance "Ga" is eliminated; the elastic ring 22 is also compressed and causes a strong reaction force which moves the projection **4*b* from the position "C" to the position "D" (FIG. 14); and then the projection is moved to the position "E" when the pressure applied to the push button 3** is released.

That is, the provision of the elastic ring 22 and the distance "Ga" required for lead thrusting makes the difference in pressure feeling between the strong and soft depressions clear and also makes the lead thrusting operation and the cartridge changing over operation sure.

A fifth embodiment of the present invention will be hereinafter described with reference to FIG. 23.

Figure 23:
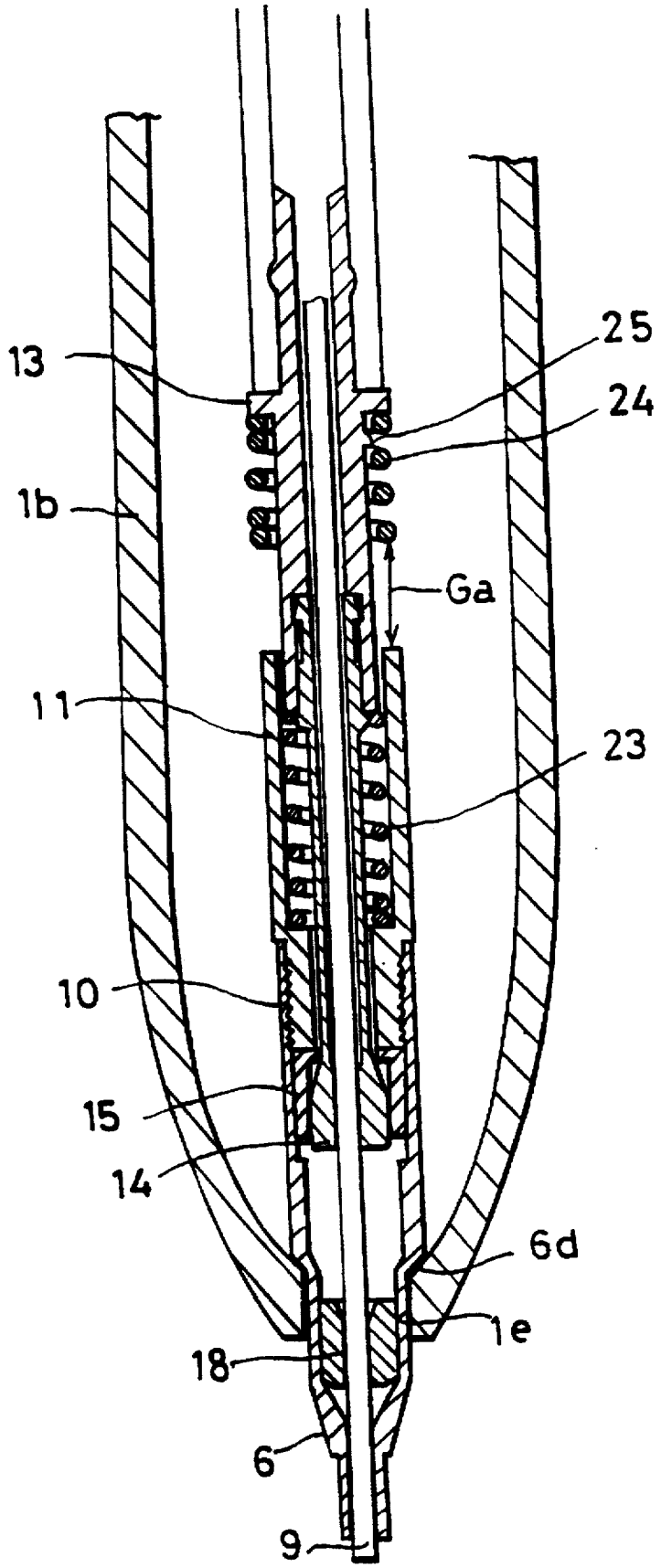
FIG. 23 is a cross-sectional view showing a fifth embodiment of the mechanical pencil cartridge.

In FIG. 23, a reference numeral 9 denotes a lead of the mechanical pencil cartridge 6; similarly, a numeral 10 a first shaft; a numeral 11 a second shaft; a numeral 13 a fourth shaft; a numeral 14 a chuck; a numeral 15 a presser ring; a numeral 18 a lead guide; a numeral 23 a fourth return spring for a distal shaft; a symbol "Ga" a distance required for lead thrusting; a numeral 24 a fifth return spring for a proximal shaft shortened by an amount of the distance "Ga"; and a numeral 25 a projection for anchoring the fifth return spring 24. The projection 25 can be omitted by slightly reducing the inner diameter of the top of the fifth spring 24.

The fifth embodiment is different from the third embodiment in that the second return spring 20 in the third embodiment is replaced with the fifth spring 24 for the proximal shaft having a spring length shortened by the distance "Ga" required for lead thrusting and in that the top end of the fifth spring 24 is secured to the fourth shaft 13 by adhesive or welding.

During the lead thrusting operation, when softly pushing the push button 3, the fourth return spring 23 for the distal shaft is compressed by the amount of the distance "Ga"; the fourth shaft 13 pushes the chuck 14 and thrusts the lead 9 with the chuck 14 holding the lead 9 until the chuck 14 is disengaged from the presser ring 15; during which the fifth return spring 24 is not compressed at all.

If the thrusted amount of the lead is not sufficient, several times of the thrusting operation of the push button 3 should be repeated until a desired length of the lead is thrusted.

When a user wishes to contain the mechanical pencil cartridge 6 within the casing 1 or to change over from the mechanical pencil cartridge 6 to the ballpoint pen cartridge 7, the push button 3 should be strongly or deeply pushed. Of course, the strong pushing operation of the push button 3 causes a compression of the fourth return spring 23; the distance "Ga" is eliminated; the fifth return spring 24 for the proximal shaft shortened by the distance "Ga" 22 is also compressed and causes a strong reaction force which moves the projection **4*b* from the position "C" to the position "D" (FIG. 14); and then the projection 4*b* is moved upward to the position "E" when the pressure applied to the push button 3** is released.

That is, the provision of the distance "Ga" required for lead thrusting makes the difference in pressure between the strong and soft depressions clear and also makes the lead thrusting operation and the cartridge changing over operation sure.

In addition, no noise is caused during use or carry of the writing tool since the top end of the fifth return spring 24 is secured to the shaft of the cartridge.

Although the combination of two cartridges of the ballpoint pen and the mechanical pencil has been shown in the illustrated embodiments, it will be appreciated that the present invention can be applied to a combination of three or four cartridges of the ballpoint pen mechanical pencil or felt-tip pen.

Such a combination can be attained by increasing the number of the saw-toothed tips 2 and the V-shaped recesses **3*b* and by reducing the width of the pushing surface 4*d***.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A combined writing tool comprising:

a cylindrical casing:

a push button extended from a top end of said cylindrical casing by force of a spring;

a plurality of writing cartridges arranged in said cylindrical casing and adapted to be alternatively extended from a bottom end of said cylindrical casing through a small aperture formed in said cylindrical casing, said writing cartridges comprising a combination of any one of a mechanical pencil a ballpoint pen and a felt-tip pen; and a cam arranged in said cylindrical casing and adapted to cause a tip of either one of said writing cartridges to be alternatively extended from and retracted in said cylindrical casing through said small aperture in response to a pushing operation of said push button;

wherein:

said push button is formed as a cylindrical body having substantially V-shaped recesses formed on a bottom end;

said cam comprises trapezoidal projections formed on an outer circumferential surface at a lower portion of an upper half portion of said cam, said trapezoidal projections being adapted to be engaged with said substantially V-shaped recesses of said push-button;

said cam is formed as a cylindrical body in which the upper half portion is adapted to be rotatably and slidably fitted in a central bore formed in said push button, said cam further comprising a pushing rod projected from a bottom end of said cylindrical upper half portion, said pushing rod having a pushing surface at a bottom thereof for engaging a top end of one of said writing cartridges slidably held in a cartridge holder arranged within said casing for pushing the writing cartridge downward:

said casing is formed, at an upper portion of an inner circumferential surface thereof with a first ridge having a first substantially saw-toothed tip for causing a rotation of said cam through sliding engagement between said first saw-toothed tip and said trapezoidal projection of said cam to push a top end of one of said writing cartridges by said pushing surface and cause a tip of said one of said writing cartridges to be extended through said small aperture, and a second ridge having at least a second substantially saw-toothed tip for causing a further rotatation of said cam through sliding engagement between said at least second saw-tooth tip and said trapezoidal projection of said cause the tip of said one writing cartridge to be retracted into said casing by said force.

2. A combined writing tool according to claim 1, wherein the writing cartridge of the mechanical pencil is formed, at a bottom end thereof,with a shoulder engageable with an inner edge of the small aperture formed at the bottom end of said cylindrical casing.

3. A combined writing tool according to claim 1, wherein said push button comprises projections formed on an outer circumferential surface of a lower portion of said cylindrical body, each projection being adapted to be slidably fitted in a respective axial groove formed on an inner surface of said cylindrical casing.

4. A combined writing tool according to claim 3 wherein each of said axial grooves is formed between said substantially saw-toothed tips and has a width which can slidably receive therein said trapezoidal projection of said cam.

5. A combined writing tool according to claim 1, wherein said pushing surface is a semilunar pushing surface and a width of said semilunar pushing surface is substantially the same as that of said substantially saw-toothed tip.

6. A combined writing tool according to claim 1, wherein two sets of said first substantially saw-toothed tip and at least second substaintially saw-tooth tip are formed on said inner circumferential surface of said casing, a difference in height between said first and at least second substantially saw-toothed tips of one set being smaller than that between said first and said second substaintially saw-toothed tips of the other set.

7. A combined writing tool according to claim 1, wherein the writing cartridge of the mechanical pencil has a lead thrusting shaft comprising a distal shaft part and a proximal shaft part, said distal shaft part being actuated via a return spring having a low spring constant and said proximal shaft part being actuated via a return spring having a high spring constant.

8. A combined writing tool according to claim 1, wherein the writing cartridge of the mechanical pencil is actuated via a return spring having a low spring constant and a return spring having a high spring constant, said return spring having a low spring constant being fitted on said writing cartridge under a precompressed condition and said return spring having a high spring constant being fitted on said writing cartridge under a non-compressed condition.

9. A combined writing tool according to claim 1, wherein the writing cartridge of the mechanical pencil has a lead thrusting shaft comprising a distal shaft part and a proximal shaft part, said proximal shaft part being connected to an elastic ring and said distal shaft part being connected to a coil spring under a precompressed condition, and a distance required for a stroke for thrusting lead of the mechanical pencil being provided between a bottom end of said elastic ring and a top end of said distal shaft part.

10. A combined writing tool according to claim 9, wherein said elastic ring is rubber.

11. A combined writing tool according to claim 9, wherein said elastic ring is plastic.

12. A combined writing tool according to claim 1, wherein said writing cartridges comprise a plurality of said ballpoint pens and said felt-tip pens having different colors.

13. A combined writing tool according to claim 1, wherein the pushing surface of said pushing rod defines a semilunar pushing surface.

14. A combined writing tool according to claim 1, wherein said writing cartridge of the mechanical pencil has a lead thrusting shaft comprising a distal shaft part and a proximal shaft part, said distal shaft part being connected to a return spring under a precompressed condition and said proximal shaft part being connected to a top portion of a further return spring, and a distance required for a stroke for thrusting lead of the mechanical pencil being provided between a bottom end of the further return spring and a top end of said distal shaft part.

* * * * *